United States Patent [19]

Herring et al.

[11] Patent Number: 4,673,373

[45] Date of Patent: Jun. 16, 1987

[54] TRANSFORMABLE TOY BLOCK AND HINGE THEREFOR

[75] Inventors: Donald E. Herring, Redondo Beach; Lawrence C. Wang, Los Angeles, both of Calif.

[73] Assignee: Mattel Inc., Hawthorne, Calif.

[21] Appl. No.: 795,283

[22] Filed: Nov. 5, 1985

[51] Int. Cl.[4] ..... A63H 3/46

[52] U.S. Cl. ..... 446/378; 446/487; 403/99; 403/102; 16/327; 16/331; 16/366

[58] Field of Search ..... 446/379, 380, 376, 378, 446/321, 487, 104, 102, 111, 112, 97, 99, 268; 403/99, 102, 101; 16/327, 341, 366, 331, 371, 334–337, 325, 321, DIG. 13; 220/335

[56] References Cited

U.S. PATENT DOCUMENTS

| | | | |
|---|---|---|---|
| Re. 31,503 | 1/1984 | Saito | 446/444 |
| 33,830 | 12/1861 | Dodge . | |
| 401,086 | 4/1889 | Turner . | |
| 497,159 | 5/1893 | Allen | 446/487 |
| 1,341,754 | 6/1920 | Lotz | 16/341 X |
| 1,550,989 | 8/1925 | Stephens | 446/97 |
| 1,618,885 | 2/1927 | Minor | 16/327 X |
| 1,660,119 | 2/1928 | Decker | 446/69 |
| 2,236,143 | 3/1941 | Kellermann | 446/470 |
| 2,245,875 | 6/1941 | Rutherford | 446/487 |
| 2,275,942 | 3/1942 | Barry . | |
| 2,364,891 | 12/1944 | Cooper . | |
| 2,503,707 | 4/1950 | Braman | 446/230 |
| 2,799,969 | 7/1957 | Henrickson | 446/69 |
| 2,943,582 | 7/1960 | Bonanno | 220/335 X |
| 2,977,688 | 4/1961 | Redey | 446/75 X |
| 3,402,422 | 9/1968 | Baer . | |
| 3,487,578 | 1/1970 | Sudermann | 446/487 |
| 3,496,670 | 2/1970 | Sloop et al. | 446/104 |
| 3,550,310 | 12/1970 | Bock-Greissau | 446/85 |
| 3,561,757 | 2/1971 | Schilling | 446/104 X |
| 3,596,396 | 8/1971 | Thomson | 446/487 |
| 3,635,432 | 1/1972 | Hollander | 403/99 X |
| 4,125,273 | 11/1978 | Rothmayer . | |
| 4,131,378 | 12/1978 | Daws . | |
| 4,144,669 | 3/1979 | Ogawa | 446/90 |
| 4,170,840 | 10/1979 | Ogawa | 446/95 |
| 4,203,248 | 5/1980 | Tapdrup | 446/97 |
| 4,205,482 | 6/1980 | Christiansen | 446/97 |
| 4,206,564 | 6/1980 | Ogawa | 446/94 |
| 4,214,403 | 7/1980 | Knudsen | 446/121 |
| 4,364,420 | 12/1982 | Kramer | 16/325 X |
| 4,382,347 | 5/1983 | Murakami | 446/433 |
| 4,391,060 | 7/1983 | Nakane | 446/94 |
| 4,393,620 | 7/1983 | Murakami | 446/457 |
| 4,435,916 | 3/1984 | Iwao et al. | 446/470 |
| 4,454,679 | 6/1984 | Ogawa . | |
| 4,477,999 | 10/1984 | Harigai et al. . | |

*Primary Examiner*—Mickey Yu

*Attorney, Agent, or Firm*—Ronald M. Goldman; Melvin A. Klein; Daniel F. Sullivan

[57] ABSTRACT

A toy block constructed into one geometrically regular block formed from at least two nestingly interengagingly configured three-dimensional components having adjacent pairs of couplers interconnected by a generally H-shaped unitary hinge, the hinge having first and second opposing sides with an interconnecting web and a transversely extending plate portion. The sides are provided with axially aligned pairs of inwardly extending pivot stub projections. The plate portion includes a pair of oppositely extending, generally resilient, aligned catch arms with depending tangs which engage detents formed between the couplers for retaining the components in preferred position. The blocks may form humanoid objects, quadrupeds, or articles such as vehicles or furniture, or the like.

18 Claims, 18 Drawing Figures

TRANSFORMABLE TOY BLOCK AND HINGE THEREFOR

BACKGROUND OF THE INVENTION

The background of the invention will be discussed in two parts:

1. Field of the Invention

This invention relates to toy blocks, and more particularly to a toy block having at least two portions connected by a hinge, pivoting of the block portions transforming the block into a figure or article.

2. Description of the Prior Art

Toys which have pivotable or extendible parts, such as toy blocks, vehicles, figures and the like have been a source of learning and amusement for children. Some such toys have one configuration, which may be transformed into another configuration unlike the first, when the parts are pivoted or extended. In the construction of some such toys, different forms of hinges and interconnections have been utilized.

In the area of blocks or sticks having hinged connections, one such device is shown and described in U.S. Pat. No. 2,245,875, by Rutherford, entitled "Toy", issued June 17, 1941, in which the device includes a plurality of plate members, pivotally connected by straps forming double acting hinges.

Another similar structure is shown and described in U.S. Pat. No. 3,487,578, entitled "Array of Blocks Joined by Double Acting Hinge Means", issued to Sudermann, on Jan. 6, 1970, the toy being a set of blocks interconnected by flexible strap members selectively secured to certain faces of the blocks.

Another device having blocks is shown and described in U.S. Pat. No. 3,496,670, entitled "Hollow Construction Toy with Hinged Connector", issued to Sloop et al on Feb. 24, 1970, the block being cubic and hollow, with certain faces having pins extending therefrom and other faces having apertures therin for receiving the pins. Some of the sides are formed with an integral hinge which may be pivoted along with like interconnected blocks.

Another block toy is shown and described in U.S. Pat. No. 3,550,310, entitled "Body of Variable Form Composed of a Plurality of Hingedly Connected Orthogonal Prisms No Less Than Six", such patent being issued to Back-Greissau, on Dec. 19, 1970, such patent disclosing a structure having arcuate portions pivotally connected to one another in such a way that they may be manipulated to form one or more figures.

U.S. Pat. No. 3,596,396, was issued Aug. 3, 1971 to Thomson for "System of Hinged Polygonic Shapes", this patent disclosing a system including a plurality of interconnected blocks with an adhesively backed strip hinge along preselected adjoining edges, pivoting about the hinges creating different overall block configurations.

Another block type toy is shown and described in U.S. Pat. No. 1,550,989, issued Aug. 25, 1925 to Stephens, entitled "Toy Block", such patent showing a channel shaped housing having first and second hinged pivotable block members therein, the opening of which simulate a figure. This patent reissued as U.S. Pat. No. Re. 16,411, on Aug. 24, 1926.

A similar type toy is shown in U.S. Pat. No. 1,660,119, issued to Decker Feb. 21, 1928, entitled "Nesting Furniture", such patent disclosing furniture like articles cut from a common block and nestable to recreate the block U.S. Pat. No. 2,977,688, was issued Apr. 4, 1961 to Redey for "Educational Cubic Toy Device", such patent disclosing a container for storing blocks, the container having hinged sidewalls for opening to create a three-walled background-producing structure for use with the blocks.

The following patents were also uncovered in a search of the prior art and are directed to toys which include two or more parts which are hinged or pivoted relative to one another to create different visual impressions.

U.S. Pat. No. 497,159, issued May 9, 1893 to Allen for a "Toy", which includes an egg-shaped container having a foldable ship like toy therein, which is unfolded upon withdrawal from the container.

U.S. Pat. No. 2,503,707, issued Apr. 11, 1950, to Braman for a "Convertible Toy", which is a toy configured to simulate a boat, with parts pivotable to represent wings and an aft portion extendible on pivoting of the wings to represent the tail of the airplane.

U.S. Pat. No. 4,144,669, issued Mar. 20, 1979, to Ogawa for a "Multiple Function Water-Going Toy", such toy having a number of reconfigurable toy parts attachable through magnetic members.

U.S. Pat. No Re. 31,503, issued Jan. 24, 1984, to Saito for a "Trackway and Powered Vehicle with Changeable Covers", such toy including a vehicle having different top portions which may be attached during travel on a trackway.

U.S. Pat. No. 2,236,143, issued to Kellermann on Mar. 25, 1941 for a "Toy Vehicle", such patent disclosing a vehicle having a roof rotatable about a longitudinal axis to create a convertible with a driver.

An "Articulated Nestable Device" is shown and described in U.S. Pat. No. 2,799,969, issued July 23, 1957, to Henrickson, the device being made up of a plurality of progressively sized, flexibly connected, nestable components.

A "Rocket Train Toy Assembly" is shown and described in U.S. Pat. No. 4,393,620, issued July 19, 1983 to Murakami, the toy including a time release mechanism for reconfiguring a toy train into a toy rocket.

Another reconfigurable toy is shown and described in U.S. Pat. No 4,435,916, issued Mar. 13, 1984 to Iwao et al for a "Toy Vehicle Capable of Changing Size and Shape", the toy vehicle having biased and extendible members operable between first and second positions to create different sized and shaped vehicles.

Another reconfigurable toy is shown and described in U.S. Pat. No. 4,477,999, issued Oct. 23, 1984 to Harigai et al for a "Transformable Toy Vehicle", the toy vehicle having pivotable and extendible body components operable between first and second positions to create different vehicles.

Another reconfigurable toy is shown and described in U.S. Pat. No. 4,382,347, issued May 10, 1983, to Murakami, for a "Toy Tractor Assembly", the toy vehicle having pivotable body components operable between first and second positions in response to a time delay mechanism.

A convertible toy is shown and described in U.S. Pat. No. 4,454,679, issued June 19, 1984 to Ogawa, for "Toy Figure Convertible into Toy Vehicle", the toy having wheels, and simulating a figure in a first position, and a vehicle in a second position with locomotion capability.

A reconfigurable toy figure is shown and described in U.S. Pat. No. 4,170,840, entitled "Toy Vehicle Doll Assembly", issued Oct. 16, 1979 to Ogawa, the toy being in the form of a humanoid with removable appendages and includes other devices for attachment to the figure to create a vehicle.

A toy figure for use with a building set is shown and described in U.S. Pat. No. 4,203,248, entitled "Toy Figure With Channeled Leg Members", such patent issuing May 20, 1980 to Tapdrup, the toy including leg members having channels or recesses for attachment to a baseboard of a building set.

Another toy figure for use with a building set is shown and described in U.S. Pat. No. 4,205,842, entitled "Toy Figure", such patent issuing June 3, 1980 to Christiansen et al, the toy including leg members having channels or recesses for attachment to a baseboard of a building set.

A reconfigurable toy is shown and described in U.S. Pat. No. 4,206,564, entitled "Articulated Reconfigurable Robot Doll", issued to Ogawa on June 10, 1980, such patent disclosing a figure toy having detachable and joinable body components, some of which are configured to depict components of other items such as vehicles and airplanes, and may be used along with other attachable components.

Another reconfigurable toy robot is shown and described in U.S. Pat. No. 4,391,060, entitled "Toy Robot Vehicle Assembly", issued to Nakane on July 5, 1983, such patent disclosing three vehicles that can operate independently as toys, or alternatively can be reconfigured to simulate a robot.

U.S. Pat. No. 33,830, entitled "Hinge", was issued Dec. 3, 1861 to Dodge, the hinge including a generally U-shaped cross-sectional member with opposite ends extending into recesses in the edges of adjacent work pieces to be hinged, with hinge pins extending through opposite arms into engagement with the work pieces, thus creating a hidden hinge.

Another hinge construction is shown and described in U.S. Pat. No. 401,086, entitled "Hinge", issued to Turner on Apr. 9, 1889, the hinge including a plate member supporting a pair of parallel hinge pins with hinge plates attached thereto for attachment within recesses of adjacent edges of the pieces to be joined.

Another hinge construction is shown and described in U.S. Pat. No. 2,275,942, entitled "Fire Screen Hinge", which issued Mar. 10, 1942, to Barry, the hinge including rod members in adjacent sections of the screen with the rod members encircled by a ring.

A hinged "Film Rack" is shown and described in U.S. Pat. No. 2,364,891, issued Dec. 12, 1944 to Cooper, such device including projections on the edges of adjoined sections, the projections being configured for retaining hinge pins therein, with the hinge pins being configured in the form of a bicycle chain master link.

A pinless hinge construction is shown and described in U.S. Pat. No. 3,402,422, entitled "Hinge", which issued to Baer on Sept. 24, 1968, such hinge including two longitudinal leaves or hinge members rotatably joined along their adjacent longitudinal edges, the structure being provided with longitudinal thrust bearing means engaging the adjacent longitudinal edges of the hinge members to prevent longitudinal movement thereof with respect to each other.

A hinge construction for a ski is disclosed in U.S. Pat. No. 4,125,273, entitled "Separable or Foldable Ski", issued to Rothmayer on Nov. 14, 1978, the patent disclosing a number of arrangements for interconnecting the parts of the ski, one such arrangement including a C-shaped hinge member having hinge pins passing through the ends of the arms of the hinge member.

U.S. Pat. No. 4,131,378, was issued to Daws on Dec. 26, 1978, and is entitled "Self-Locking Hinge", the hinge including hinge pins interconnected by a spring for connection of tubular elements while permitting pivoting.

A "Hinge Element" is shown and described in U.S. Pat. No. 4,214,403, issued July 29, 1980 to Knudsen, the hinge element including a tubular bush in a corner of a block and a complementary pivot pin in a corner of another block.

It is an object of the present invention to provide a new and improved toy block.

It is another object of the present invention to provide a new and improved toy block having at least two irregularly configured components hingedly nestingly interconnected to fold into a generally regular geometric three dimensional block.

It is still another object of the present invention to provide a new and improved toy block capable of assuming different configurations.

It is a still further object of the present invention to provide a new and improved hinge coupling mechanism for interconnecting three dimensional components.

It is a further object of the present invention to provide a new and improved toy block having pivotally hinged components, which may be manipulated to form a figure or article.

SUMMARY OF THE INVENTION

The foregoing and other objects are accomplished by providing a toy block constructed into one geometrically regular block formed from at least two interengagingly configured three-dimensional components interconnected by a generally H-shaped unitary hinge, the hinge having first and second generally parallel side portions with an integrally formed transversely extending web portion interconnecting the top edges. Opposite ends of the side portions are provided with aligned inwardly extending pivot stub projections. The web portion includes a pair of oppositely extending, generally resilient, aligned catch arms with depending tangs. The interconnecting adjacent portions of the block components are formed to provide generally U-shaped openings for receiving therein the pivot stub projections. The exterior of the bight portion of the U-shaped openings are provided with ledge portions for engagement with the tangs for retaining the components in preferred positions. The blocks may form humanoid objects, quadrupeds, or articles such as vehicles or furniture, or the like.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
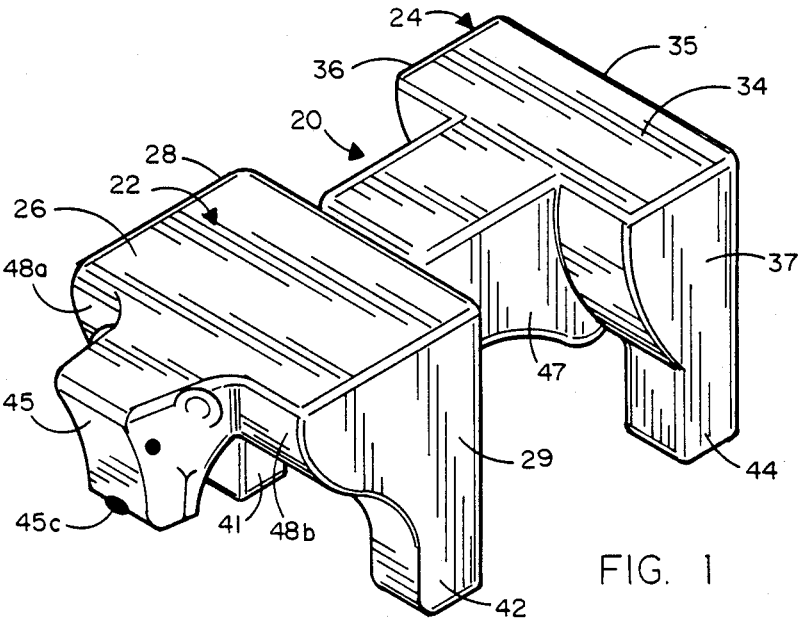
FIG. 1 is a perspective view of a toy block in accordance with the present invention, the block being opened to depict a quadruped.

Referring now to the drawings, and particularly to FIG. 1, there is shown a toy block, generally designated 20, in its opened position, generally depicting a quadruped, such as a bear. Referring also to FIG. 2 through 9, the block 20 is in generally regular cubical form in its closed position (See FIGS. 6, 7 and 9), and is formed of two components, generally designated 22 and 24 Each component 22, 24 is configured with three-dimensional interengaging portions having the desired configuration of the ultimate animate or inanimate object to be depicted in the open position.

Component 22, which forms the forward portion of the quadruped formed by the opened block 20 has at least two generally planar generally transverse surfaces 26, 27, and two opposing intersecting planar side surfaces 28, 29 which form portions of the outside surfaces of the block 20 in its closed position. Similarly, component 24, which forms the rear portion of the quadruped has first and second mutually perpendicular surfaces 34, 35, which partially form the back and rear of the quadruped, with intersecting opposing side surfaces 36, 37 which, likewise form portions of the outside surfaces of the block 20 in its closed position, and a planar surface 38 generally perpendicular to the surface 34.

The components 22 and 24 are interconnected by a hinge mechanism, generally designated 40, which interconnects the surface 38 of component 24 to the surface 27 of the component 22 at a point approximately half the distance of a side of the cube so-formed. The components 22 and 24 are configured to form front legs 41, 42, rear legs 43, 44 and a head portion 45, as well as the torso of the quadruped, with the dimensions of the various portions sufficent to enable portions of the appendages to be interengaged to provide the general appearance of a regular geometric solid form, such as a cube, a rectangular parallelepiped, or even a truncated pyramidal configuration with the block 20 in its closed position as depicted in FIGS. 6 and 7.

Figure 2:
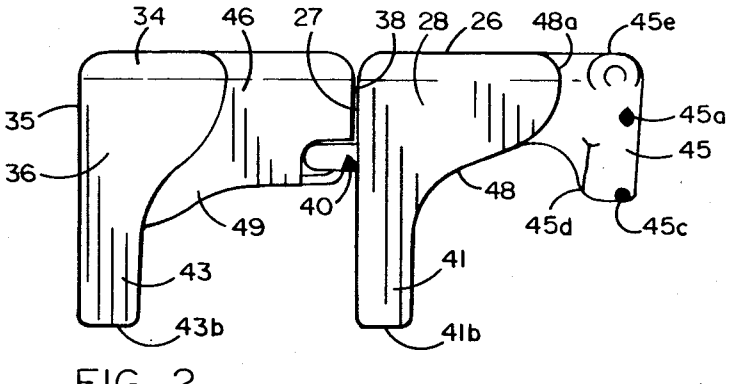
FIG. 2 is a side elevational view of the transformed toy block of FIG. 1.
Figure 5:
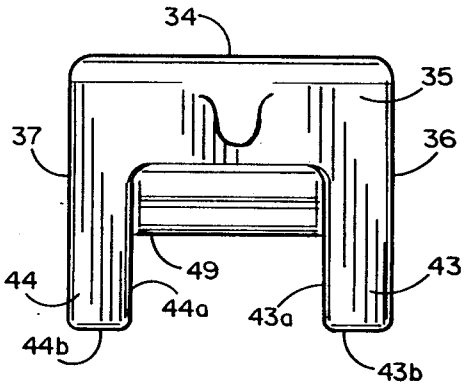
FIG. 5 is a rear view of the transformed toy block of FIG. 1.
Figure 4:
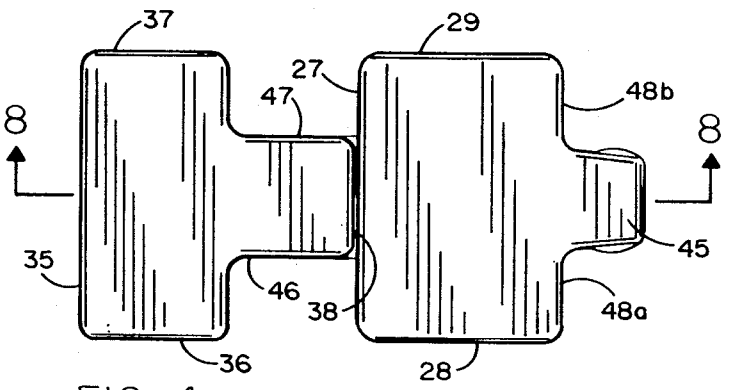
FIG. 4 is a top plan view of the transformed toy block of FIG. 1.

The forward component 22 includes the front legs 41 and 42 as well as a head portion 45. The rear component 24 includes the rear legs 43 and 44. The sides of the rear component 24 have recessed generally parallel surfaces 46, 47 spaced inwardly from and parallel to the surfaces 36, 37, respectively, the distance between surfaces 46, 47 being dimensionally generally equal to the distance between the front legs 41 and 42, which are of generally equal width with the inner facing surfaces 41*a* and 42*a* thereof, generally parallel and generally planar. Similarly, the rear legs 43 and 44 have the inner facing surfaces 43*a* and 44*a* thereof generally planar and generally parallel to provide a space therebetween. In the open position as shown in FIG. 2, the components 22 and 24 are provided with generally contiguous arcuate undersurfaces 48 and 49, respectively, with the hinge mechanism 40 at the juncture of the two surfaces 48 and 49.

Figure 3:
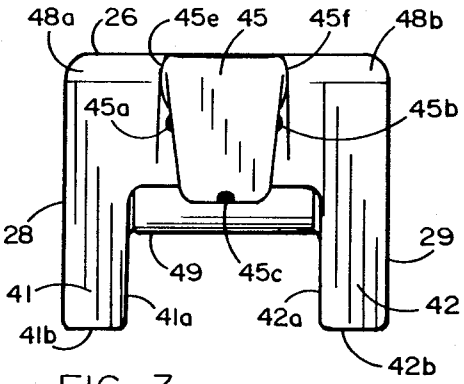
FIG. 3 is a front elevational view of the transformed block of FIG. 2.

The front component 22 has first and second generally aligned arcuate surfaces 48*a* and 48*b* extending form the surface 27 to the surface 48 with head portion 45 extending out therefrom, the surfaces 48*a* and 48*b* forming simulated shoulder portions. Head portion 45 is configured in the form of a head of a quadruped, such as a bear. The components 22 and 24 are preferably made of a molded plastic material, and elements such as eyes 45*a* and 45*b*, a nose 45*c*, and a mouth 45*d* may be suitably formed therein Similarly, ears 45*e* and 45*f* may be molded into the sides of the head 45. In front view, as shown in FIG. 3, the width of the head 45 is less then the width of the space between the rear legs 43 and 44, while in top view, the head 45 is somewhat tapered.

Figure 6:
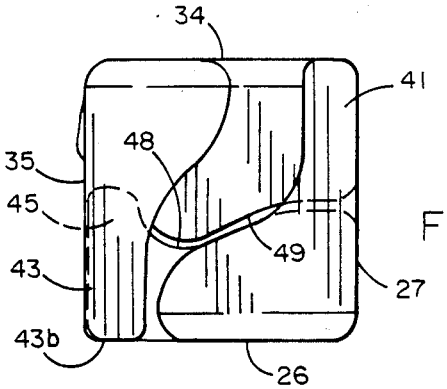
FIG. 6 is a side view of the toy block of FIG. 1 in its closed position.
Figure 7:
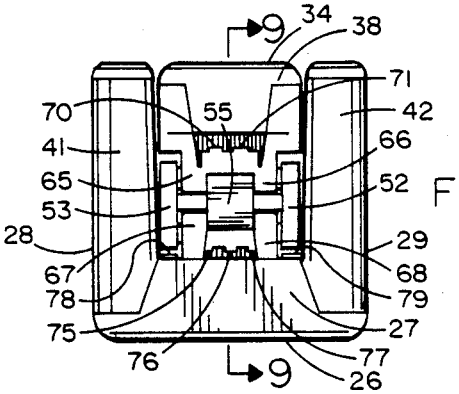
FIG. 7 is a right side view of the toy block of FIG. 6 in its closed position.

As the front component 22 is pivoted about hinge mechanism 40, the legs 41 and 42 slidingly engage the surfaces 46 and 47, respectively, with the head portion 45 tucking into nesting realtion under the surface of the rear component 22, until the component 22 is pivoted approximately ninety degrees into interengaging relation with the component 24, thus creating the block 20 as shown in FIGS. 6 and 7. In this position, the two arcuate undersurfaces 48 and 49 are in abutting relation, with the legs 41 and 42 in proximate inverted relation to the rear legs 43 and 44, respectively.

In the positions of the closed block shown in FIGS. 6 and 7, the side surfaces 28 and 36 of the front and rear components 22 and 24, respectively, are coplanar. Similarly, the side surfaces 29 and 37 of the front and rear components 22 and 24, respectively, are coplanar. The top surface of the blcok 20 as depicted in FIGS. 6 and 7 is formed by the top surface 34 of the rear component 22, and the coplanar bottom edges 41*b* and 42*b* of the front legs 41 and 42. The bottom surface of the block 20 is formed by the top surface 26 of the component 24 which is coplanar with the bottom edges 43*b* and 44*b* of the rear legs 43 and 44, respectively. Similarly, the right side, as viewed in FIG. 6 is formed by the coplanar surfaces 27 and 38 of the front and rear components 22 and 24, respectively, with the opposite side formed by the rear surface 35 of the component 24, with the front surface of the head 45 slightly recessed therein. As configured, a generally cubical block is formed for play with other like blocks to build simulated block objects or structures.

Figure 8:
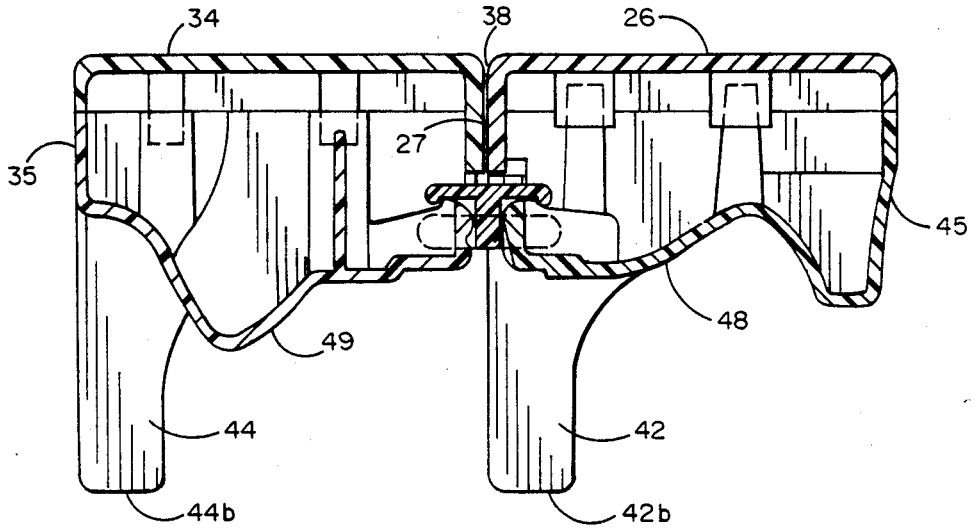
FIG. 8 is a cross-sectional view of the transformed toy block of FIG. 4 as viewed generally along line 8—8 thereof.
Figure 9:
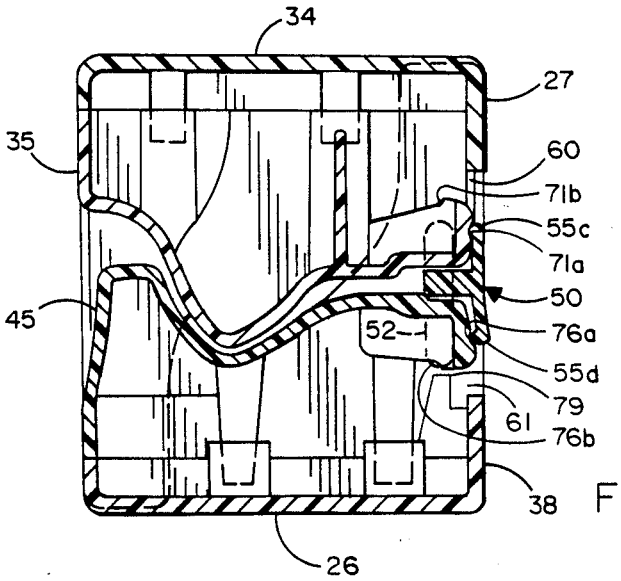
FIG. 9 is a cross-sectional view of the closed toy block of FIG. 7 as viewed generally along line 9—9 thereof.
Figure 10:
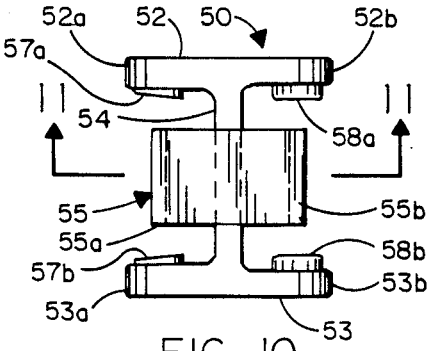
FIG. 10 is a top plan view of the hinge used in the toy block of FIG. 1.
Figure 13:
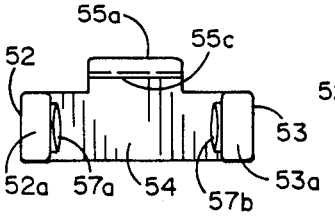
FIG. 13 is a left end view of the hinge of FIG. 10.
Figure 11:
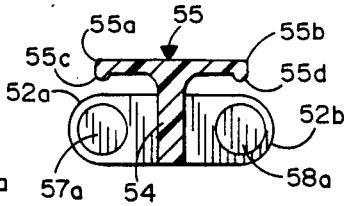
FIG. 11 is a cross-sectional view of the hinge of FIG. 10 as viewed generally along line 11—11 thereof.
Figure 14:
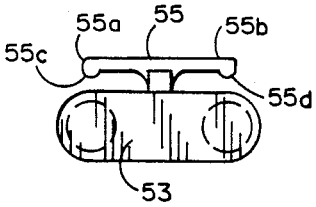
FIG. 14 is a side elevational view of the hinge of FIG. 10.
Figure 12:
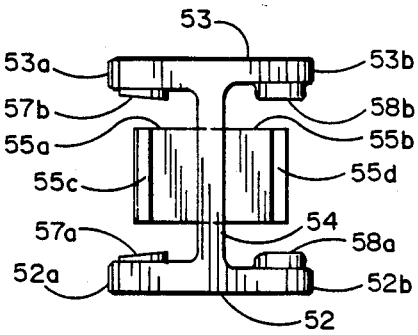
FIG. 12 is a bottom plan view of the hinge of FIG. 10.
Figure 16:
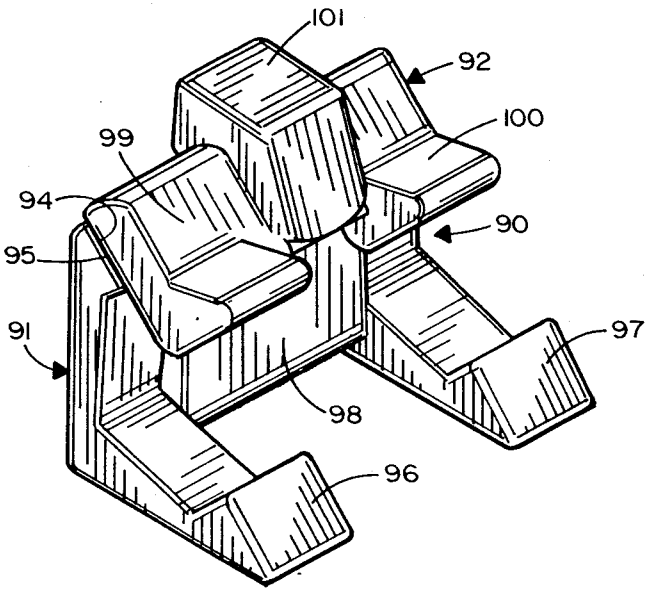
FIG. 16 is a perspective view of the toy block of FIG. 15, depicted in its open position.
Figure 15:
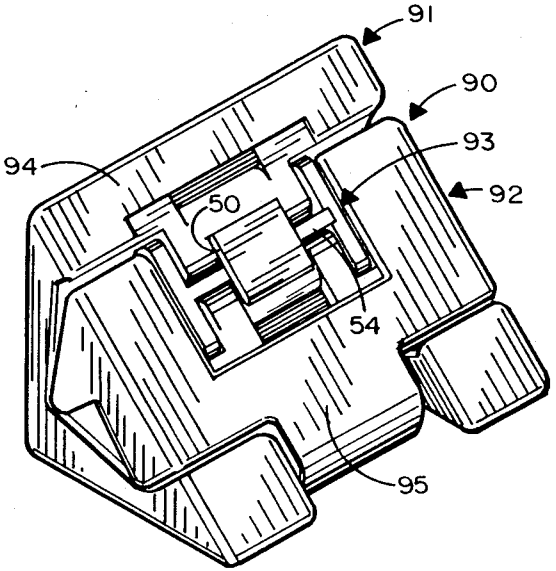
FIG. 15 is a perspective view of another triangularly configured toy block, similar to the block of FIG. 1, in a closed position.

Referring now to FIGS. 7 through 14, the details pertaining to the hinge mechanism 40 and the interrelationship of the hinge mechanism 40 to the surfaces 48 and 49 will be described. The hinge mechanism 40 includes a unitary hinge member 50, which as best shown in FIGS. 10 and 12, is generally H-shaped in top plan view with generally opposing parallel bar-shaped sides 52, 53 and an interconnecting bar-shaped elongate web portion 54. A generally resilient plate member 55 extends transversely to the plane of the web portion 54 and is disposed generally centrally relative thereto, the plate 55 having first and second aligned, oppositely extending arm portions 55*a* and 55*b*. The inner opposing surfaces of the sides 52, 53 have integrally formed therewith pairs of inwardly extending axially aligned pivot stub projections, one set of projections 57*a* and 57*b* being formed on the inner surfaces of ends 52*a* and 53*a*, respectively, and the other set of projections 58*a* and 58*b* being formed on the inner facing surfaces of ends 52*b* and 53*b* of sides 52 and 53, respectively.

As illustrated in cross-section in FIG. 11, the plate member 55 is displaced upwardly (as viewed therein) from, and generally parallel to, the upper edges of the sides 52 and 53. The terminal edges of the arm portions 55*a* and 55*b* of plate member 55 are provided with depending tangs 55*c* and 55*d*, respectively, these tangs extending along a line passing through the centers of the two sets 57 and 58 of stub projections. The sets 57 and 58 of stub projections essentially form a pair of parallel pivot axes for the hinge member 50. The hinge member 50 is preferably formed of a somewhat resilient, somewhat flexible, yet rigid material, such as plastic or nylon or the like. The sides 52, 53 and web portion 54 are thicker in cross-section than the plate member 55, thus providing less flexibility or resilience in the sides 52, 53 and web portion 54, while providing more resiliency and flexibility in the arm portions 55*a* and 55*b*.

As shown in FIGS. 10 and 12, one set 57 of projections 57*a*, 57*b* has the ends thereof tapered, while the ends of projections 58*a* and 58*b* are generally parallel to the sides 52, 53. The taper of the tapered projections 57*a*, 57*b* is in a direction to facilitate insertion into a mating hinge portion formed on one or both components 22, 24.

Referring now to FIGS. 7 through 9, the interior of components 22 and 24 are generally hollow with each being formed in two parts with the normal array of interior, integrally formed connecting bosses and apertures. As best shown in FIG. 7, the adjacent corners of the the components 22 and 24 are specially configured to form part of the hinge mechanism 40 with the hinge member 50 coacting with matingly attachable parts to provide a double acting hinge mechanism, that is, each component 22, 24, itself may be pivoted along the pivot axis defined by its interconnecting set of pivot projections 57, 58, and the hinge member 50 itself may be pivoted relative to either component 22, 24, along the pivot axis of either set of pivot projections 57, 58, thereby providing clearance between corners of the components 22, 24 adjacent the hinge member 50.

In addition, as will be described, the hinge mechanism 40 is provided with stop means which frictionally coact with the tangs 55*c* and 55*d* of the hinge member 50 at certain angular positions to assist in maintaining the components 22 and 24 at certain stable angular relations, such as the opened and closed positions, shown in FIGS. 1 and 6. As depicted in FIG. 7, the adjacent surfaces 38 and 27 of components 22 and 24, respectively, form a common plane of one side of the block 20 in its closed position. The hinge member 50 is inserted in such a manner that the upper surface of the plate portion 55 lies in this common plane with the sides 52 and 53 fitted within aligned pairs of slots formed in the contiguous interconnected corners of components 22 and 24.

By reference to FIGS. 7 through 9, the surface 27 of component 22 in a central portion thereof, terminates short of the corner to provide an access opening 60 for receiving therein a portion of the hinge member 50. Similarly, the surface 38 of component 24 at a central portion thereof terminates short of the intersection with the surface 48 to provide an aligned access opening 61 for receiving therein the opposite portion of the hinge member 50. Integrally formed on the interior of components 22 and 24 are parallel pairs of generally U-shaped hinge projection receiving couplers, such as pair 65, 66 of component 24 and pair 67, 68 of component 24. The pair of aligned couplers 65, 66 receive therein the stub projections 57*a*, 57*b*, and the pair of aligned couplers 67, 68 receive therein the stub pivot projections 58*a*, 58*b*. Intermediate the pair of couplers 65, 66 of component 24, there are integrally formed arcuate ribs 70–71, and intermediate the pair of couplers 67, 68 of component 22, there are integrally formed arcuate ribs 75–77.

As shown in side view in FIGS. 8 and 9, these arcuate ribs define an arcuate surface for engagement with the depending tangs 55*c* and 55*d* of hinge member 50. The edges are so-formed and positioned that, as assembled, the arms 55*a* and 55*b* of plate 55 of hinge member 50 are slightly bent outwardly, thus providing a bias which urges the tangs 55*c* and 55*d* into contact with these arcuate edges, that is the first set of ribs 70–71 and the second set of ribs 75–77. As shown in FIGS. 8 and 9, each one of each set of ribs is provided with aligned first and second detents, such as detents 71*a* and 71*b* in rib 70 of component 22, and correspondingly detents 76*a* and 76*b* in rib 76 of component 24. These aligned sets of detents coact with the tangs 55*c* and 55*d* in two different angular orientations to assist in maintaining the relation of the hinge member 50 relative to the respective component 22 or 24 in one of two stable positions, a stable position corresponding to the angular position in which the respective tang 55*c* or 55*d* is in coacting engagement with a given set of aligned detents. Normally these two preferred angular positions will correspond to the fully open position of the components 22 and 24 as shown in FIG. 1 or the fully closed position as shown in FIGS. 6 and 7.

Formed on the interior of the component 22 are bar members which terminate in proximate relation to the opposite ends of the sides 52 and 53 of the hinge member 50. The bar members 78 and 79 are in general alignment with each other and with the plane of the side 52. These bar members serve to restrain the position of the hinge 50 during pivoting.

As force is applied to the two components 22 and 24, this force overcomes the force of the detented engagement of the tangs 55*c* and 55*d*, and pivoting of the two parts is easily accomplished until the opposite detenting engagement is encountered. With this detenting arrangement, the positions of the two components 22 and 24 are relatively stable in either the fully opened or fully closed positions. When opened as shown in FIG. 1, the block 20 may be played with as a quadruped figure and may freely be moved about without collapsing. Similarly, in the closed position, the block 20 may be used with other similar or conventional blocks as a building set, without the parts separating.

Referring now to FIGS. 15 through 18, in accordance with the invention, there are shown two other configurations of toy blocks, generally designated 90 and 110. The block 90 is of a triangular prismatic form while the block 110 is in generally cubical form. Each incorporates a hinge mechanism generally identical to the hinge mechanism 50, which allows the two components thereof to be pivoted about a line extending through one surface of the block 90 or 110.

Block 90 has first and second components 91 and 92 interconnected by a hinge mechanism, generally designated 93, the mechanism 93 including a hinge member 50 which hingedly couples the two coplanar surfaces 94 and 95 of components 91 and 92, respectively, which form the hypotenuse of the triangle. In this embodiment, the plane of the web portion 54 of the hinge 50 does not bisect the combined surface 94, 95, but divides it into approxiamtely one-third, two-thirds. With the components 91, 92 pivoted to the opened position shown in FIG. 16, the surfaces 94 and 95 are in abutting, rather than coplanar relation to form a simulated humanoid figure in a sitting position. The component 91 has formed therewith the rear legs 96 and 97 as well as the lower torso 98, while the component 92 has formed therewith the arm and shoulder member 99 and 100, as well as head portion 101. As can be seen the width of the head is of a distance slightly less than the width of the legs 96 and 97 for enabling the head 101 to be tucked therebetween upon closing to the position shown in FIG. 15. Similarly, the arm and shoulder portions 99, 100 are configured for nesting interengaging relation within the spaces provided in the upper leg portions 96, 97, respectively. Again, the resulting block 90 may be played with in its closed position, as a building block.

Figure 18:
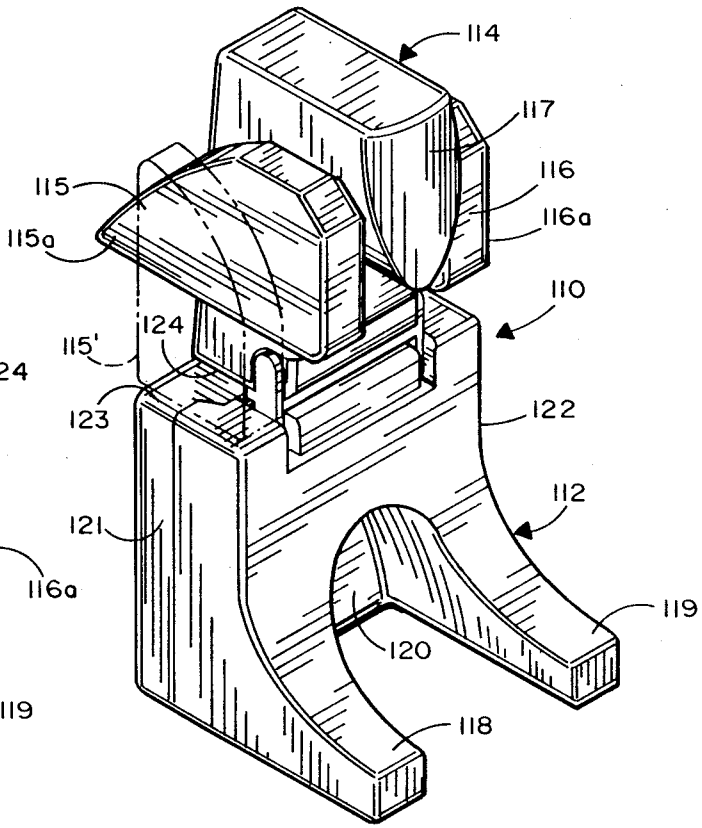
FIG. 18 is a perspective view of the toy block of FIG. 17, depicted in its open position.
Figure 17:
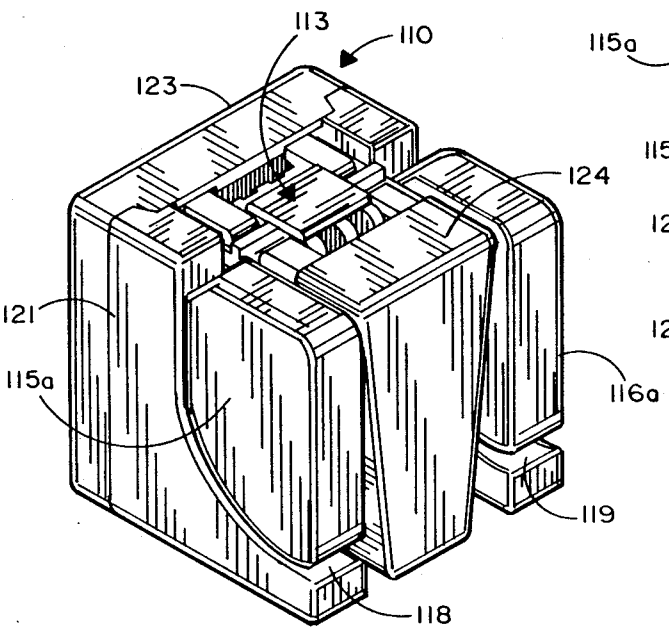
FIG. 17 is a perspective view of another toy block, similar to the block of FIG. 1, in a closed position.

The block 110 of FIGS. 17 and 18 is of generally cubical form, however, additional components have been added to provide additional manipulative elements. The block 110 is formed of first and second components 112 and 114 pivotally coupled together with a hinge mechanism, generally designated 113, with supplemental pivotable components 115 (pivotable to dotted line depiction 115') and 116 supported by the component 114, the components 115 and 116 being configured to simulate arms of the humanoid cretaure so-created. The component 114 is configured basically as the head 117 and upper torso of the creature with the component 112 being configured as the lower torso and legs 118, 119, with the space therebetween being configured to form a cavity 120 into which the head 117 extends upon closing.

The forward surface of the lower component 112 is arcuarely configured, with the arm components 115 and 116 having an edge thereof matingly configured for abutting relation therewith in the closed position, as shown in FIG. 17. In the closed position, the outer surfaces **115*a* and 116*a* of the arm components 115 and 116 are coplanar with the opposite side surfaces 120 and 121 of the lower component 112. Similarly, the other four surfaces of the block 110 will have substantial portions thereof generally planar for enabling use of the block 110 as a building block. The arm components 115 and 116 may be attached to the component 114 in any convenient manner such as by hinge bosses, or hinge pins or the like. The hinge mechanism 113 is virtually identical to the hinge mechanism 40 with the web portion 54 of the web 50 thereof generally bisecting the upper surface formed by coplanar adjacent surfaces 123 and 124 of components 112 and 114, respectively, as well as end surfaces 115*b* and 116*b* of the arm components 115 and 116**, respectively.

In accordance with the present invention, three different embodiments of blocks using a common hinge mechanism have been illustrated with each forming a block of at least two pivotally interconnected nestingly interengaging components transformable into a figure. It is to be understood, however, that the blocks may be configured for bein transformable into other objects, such as vehicles or articles of furniture by use of the hinge mechanism described. While there have been shown and described preferred embodiments, it is to be understood that various other adaptations and modifications may be made within the spirit and scope of the invention.

We claim:

1. In a hinge mechanism for intercoupling adjacent corners of first and second three-dimensional components, the hinge mechanism comprising:

first and second pairs of spaced generally U-shaped hinge couplers formed at the adjacent corners of said first and second a hinge member having first and second generally parallel opposing side members, an interconnecting web portion, and a plate portion extending transversely to said web portion and having oppositely extending generally resilient arm portions with tang means thereon;

first and second sets of aligned hinge stub projections formed in said side members for engagement with said first and second pairs of U-shaped hinge couplers; and detent means on said first and second components intermediate said couplers for cooperative interengagement with said tang means for resiliently retaining said first and second components in each of first and second positions of relative pivotal displacement.

2. The hinge mechanism according to claim 1 wherein said detent means are formed on arcuately configured surface means intermediate said spaced hinge couplers on said first and-second components, said surface means having first and second detent means formed therein, and said plate member has first and second opposing tang means for engaging said first detent means in a first relatively pivoted position of said components and for engaging said second detent means in a second relatively pivtoed position of said components.

3. The hinge mechanism according to claim 2 wherein said hinge member is a unitary member formed of a generally resilient plastic material.

4. In a toy block capable of being transformed into another form, the combination comprising:

a first generally three-dimensional component having at least one corner at the edge of a generally planar surface;

a second generally three-dimensional component having at least one corner at the edge of a generally planar surface, said first and second components being interconnected by hinge means at said at least one corners, each of said first and second components having portions thereof configured for nesting interengagement with the other when hinged into a closed position with the portions being configured to form a figure or the like in an opened position; and said hinge means including a pair of spaced coupler means formed on each of said at least one corners and a hinge member having first and second pairs of spaced aligned hinge projections engaging said coupler means, said hinge means also including positioning means for frictionally retaining said hinge member in first and second postions relative to said first and second components, said first position being in the closed position with said first and second components in nesting relation, and said second position being with said components in the open position to form a figure or the like, and wherein said hinge member is a unitary generally H-shaped hinge member with first and second generally parallel spaced sides and an interconnecting web portion, wherein said positioning means includes a plate portion on said hinge member having oppositely extending generally resilient arm portions with tang means thereon, and detent means formed on said first and second components adjacent said at least one corners, and wherein said plate portion is formed with said hinge member and extends transversely to said web portion.

5. The toy block according to claim 1 wherein said tang means are formed on the opposite ends of said arm portions of said plate portion.

6. The toy block according to claim 1 wherein said toy block in its closed position is generally cubical in form and, in its closed position, said planar surfaces form one side of the block.

7. The toy block according to claim 6 wherein said first and second components are configured to form a quadruped with said block in its opened position.

8. The toy block according to claim 1 wherein said toy block in its closed position is of a generally triangular prismatic form and, in its closed position, said planar surfaces form one side of the block.

9. The toy block according to claim 8 wherein said first and second components are configured to form a humanoid figure with said block in its opened position.

10. In an article having the form of a three-dimensional geometric toy block in a first position and the form of a figure or the like in a seoond position, the combination comprising:

a first genarally three-dimensional component;

a second generally three-dimensional component each of said first and second components having portions thereof configured for interengaging nesting relation in said first position;

a hinge mechanism interconnecting a corner of said first component with a corner of said second component to form, in the first position, a side of said block, said hinge mechanism including first and second pairs of spaced generally U-shaped hinge couplers formed at the adjacent corners of said first and second components, a hinge member having first and second generally parallel opposing side members and an interconnecting web portion with first and second sets of aligned hinge stub projections formed in said side members engaging said first and second pairs of U-shaped couplers, said hinge member, having an integrally formed plate portion extending transversely to said web portion and having oppositely extending generally resilient arm portions with tang means thereon; and detent means on said first and second components engageable with said tang means for resiliently retaining said first and second components in said first and second positions.

11. Ihe article according to claim 10 wherein each of the interconnected corners of said first and second components are at the edge of first and second generally planar surfaces, and said article in its first position is of a generally triangular prismatic form and said planar surfaces form one side of the block.

12. The article of claim 11 wherein each of said first and seocnd components are configured to form a humanoid figure with said block in its second position.

13. The article according to claim 10 wherein said detent means are formed on arcuately configured surface means formed intermediate said spaced hinge couplers on said first and second components, said surface means having first and second detent means formed therein, and said plate member, has first and second opposing tang means for engaging said first detent means in the first position of said block and for engaging said second detent means in the second position of said block.

14. The article according to claim 13 wherein said hinge stub projections are in facing relation.

15. The article according to claim 14 wherein at least one pair of said hinge stub projections have tapered ends to facilitate assembly of said article.

16. The article according to claim 10 wherein each of the interconnected corners of said first and second components are at the edge of first and second generally planar surfaces, and said article in its first position is generally cubical in form and said planar surfaces form one side of the block.

17. The article according to claim 16 wherein said first and second components are configured to form a quadruped with said article in its second position.

18. The article according to claim 17 further including at least one other component pivotally coupled to one of said first and second components.

* * * * *